US008349788B2

(12) United States Patent
Taylor

(10) Patent No.: US 8,349,788 B2
(45) **Date of Patent: *Jan. 8, 2013**

(54) COTTON-GENTLE HYPOCHLORITE BLEACH

(76) Inventor: Lawnie Henderson Taylor, Germantown, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/373,399

(22) Filed: Nov. 14, 2011

(65) Prior Publication Data

US 2012/0080535 A1 Apr. 5, 2012

Related U.S. Application Data

(63) Continuation of application No. 11/505,445, filed on Aug. 17, 2006, which is a continuation of application No. 10/612,016, filed on Jul. 3, 2003, now Pat. No. 7,109,157, which is a continuation-in-part of application No. 10/373,787, filed on Feb. 27, 2003, now Pat. No. 6,946,435.

(60) Provisional application No. 60/423,978, filed on Nov. 6, 2002.

(51) Int. Cl.
*C11D 3/395* (2006.01)
*C11D 7/06* (2006.01)

(52) U.S. Cl. ..... 510/380; 510/276; 510/281; 510/286; 510/302; 510/339; 510/367; 510/379

(58) Field of Classification Search ..... 510/276, 510/281, 286, 302, 339, 367, 379, 380
See application file for complete search history.

(56) References Cited

U.S. PATENT DOCUMENTS

| | | | | | |
|---|---|---|---|---|---|
| 1,514,068 | A | | 11/1924 | Phair | |
| 3,929,661 | A | * | 12/1975 | Nakagawa et al. | 510/370 |
| 4,474,677 | A | | 10/1984 | Foxlee | |
| 4,554,091 | A | | 11/1985 | Jones et al. | |
| 4,622,037 | A | * | 11/1986 | Streit et al. | 8/108.1 |
| 4,740,213 | A | | 4/1988 | Ricci | |
| 4,832,864 | A | | 5/1989 | Olson | |
| 4,888,323 | A | * | 12/1989 | Matsuda et al. | 512/23 |
| 4,912,056 | A | | 3/1990 | Olson | |
| 4,929,383 | A | * | 5/1990 | Haendler | 252/187.26 |
| 5,006,126 | A | | 4/1991 | Olson et al. | |
| 5,075,029 | A | | 12/1991 | Haendler | |
| 5,104,571 | A | * | 4/1992 | Cramer | 252/187.24 |
| 5,122,159 | A | | 6/1992 | Olson et al. | |
| 5,131,915 | A | | 7/1992 | Mendoza | |
| 5,250,512 | A | | 10/1993 | Ohmoto et al. | |
| 5,287,960 | A | | 2/1994 | Kalb et al. | |
| 5,567,207 | A | | 10/1996 | Lockman et al. | |
| 5,573,710 | A | | 11/1996 | McDonell et al. | |
| 5,604,571 | A | | 2/1997 | Kato et al. | |
| 5,731,276 | A | * | 3/1998 | Argo et al. | 510/284 |
| 5,746,936 | A | * | 5/1998 | Mercado | 252/187.25 |
| 5,814,591 | A | | 9/1998 | Mills et al. | |
| 5,830,839 | A | | 11/1998 | Scepanski | |
| 5,843,190 | A | * | 12/1998 | Agostini et al. | 8/108.1 |
| 5,872,090 | A | | 2/1999 | You et al. | |
| 5,877,315 | A | | 3/1999 | Deline et al. | |
| 5,904,735 | A | | 5/1999 | Gutierrez et al. | |
| 5,961,879 | A | * | 10/1999 | Trigiante | 252/187.25 |
| 5,972,876 | A | | 10/1999 | Robbins et al. | |
| 5,997,585 | A | | 12/1999 | Scialla et al. | |
| 6,004,916 | A | | 12/1999 | Mills et al. | |
| 6,090,770 | A | | 7/2000 | Mendoza et al. | |
| 6,120,555 | A | * | 9/2000 | Scialla et al. | 8/108.1 |
| 6,153,120 | A | | 11/2000 | Scialla et al. | |
| 6,200,941 | B1 | | 3/2001 | Strandburg et al. | |
| 6,204,235 | B1 | * | 3/2001 | Jimenez Carrillo et al. | 510/379 |
| 6,211,131 | B1 | | 4/2001 | Kaaret et al. | |
| 6,214,784 | B1 | | 4/2001 | Robbins et al. | |
| 6,277,153 | B1 | | 8/2001 | Van Kouwen et al. | |
| 6,297,209 | B1 | | 10/2001 | Kaaret et al. | |
| 6,398,077 | B1 | | 6/2002 | Gross et al. | |
| 6,413,925 | B2 | | 7/2002 | Akbarian et al. | |
| 6,416,687 | B1 | * | 7/2002 | Agostini et al. | 252/186.42 |
| 6,448,215 | B1 | * | 9/2002 | Grande et al. | 510/380 |
| 6,468,954 | B2 | | 10/2002 | Levitt et al. | |
| 6,506,718 | B1 | | 1/2003 | Todini | |
| 6,534,465 | B1 | * | 3/2003 | Briatore et al. | 510/380 |
| 6,537,960 | B1 | | 3/2003 | Ruhr et al. | |
| 6,624,134 | B1 | | 9/2003 | Briatore et al. | |
| 6,649,583 | B2 | | 11/2003 | Todini | |
| 6,774,098 | B2 | | 8/2004 | Taylor | |
| 6,894,015 | B1 | * | 5/2005 | Briatore et al. | 510/303 |
| 6,946,435 | B1 | | 9/2005 | Taylor | |

(Continued)

FOREIGN PATENT DOCUMENTS

| | | |
|---|---|---|
| WO | WO/2006/110326 | 10/2006 |
| WO | WO/2007/142640 | 12/2007 |

OTHER PUBLICATIONS

International Search Report for PCT/US06/11413 mailed Jul. 21, 2008.

International Search Report for PCT/US06/022148 mailed Feb. 28, 2007.

Peter, M., Rouette, H.K., "Grunlagen der Textilveredlung," 1991, Deutscher Fachverlag, Frankfurt, DE, XP002420616, pp. 462-463, paragraph [7.211.1].

Church & Dwight Co., Consumer Products, Specialty Products, Material Safety Data Sheet, Scrub Free Mildew Stain Remover, p. 5, Jul. 10, 2002.

(Continued)

*Primary Examiner* — Charles Boyer

(57) ABSTRACT

This invention discovers that laundry-strength hypochlorite bleach compositions are described by three essential components; hypochlorite, hydroxide, and the concentration ratio (CR), the latter defined as the concentration of hypochlorite over the concentration of hydroxide (also, its reciprocal). The hypochlorite content determines fabric cleaning efficacy, the hydroxide content determines stability, and the CR indicates quality of fabric safety, such quality ranging from damaging to gentle. Therefore, hypochlorite bleach compositions can range from fabric damaging to degrees of fabric protection, depending upon the values of CR. Values of CR (as defined) greater than 30:1 characterize fabric-damaging common regular bleach. By decreasing the ratio value, fabric protection progressively improves to a relatively broad maximum at a ratio value about 2:1.

130 Claims, No Drawings

U.S. PATENT DOCUMENTS

| | | | | |
|---|---|---|---|---|
| 7,109,157 | B2 | 9/2006 | Taylor | |
| 7,288,616 | B2 * | 10/2007 | Tamareselvy et al. | 526/333 |
| 7,582,595 | B1 * | 9/2009 | Taylor | 510/380 |
| 7,582,596 | B1 * | 9/2009 | Taylor | 510/380 |
| 7,585,829 | B1 * | 9/2009 | Taylor | 510/380 |
| 7,628,822 | B2 | 12/2009 | Taylor | |
| 2002/0189633 | A1 * | 12/2002 | Powers et al. | 134/1 |
| 2003/0032565 | A1 * | 2/2003 | Sivik | 510/101 |
| 2003/0171234 | A1 | 9/2003 | Ajmani et al. | |
| 2004/0072712 | A1 * | 4/2004 | Man et al. | 510/379 |
| 2004/0168260 | A1 | 9/2004 | Taylor | |
| 2006/0225224 | A1 | 10/2006 | Taylor | |
| 2006/0281657 | A1 | 12/2006 | Taylor | |
| 2007/0287652 | A1 | 12/2007 | Taylor | |

OTHER PUBLICATIONS

Chlorox Bleach for Intitutional Use, MSDS Safety Information, Item Name: Sodium Hypochlorite Solution, p. 5, 1992.

Specialty Hypochlorites vs. Commodity Bleach, Which Should You Be Using? The Olin Corporation, p. 4, Jan. 27, 2003.

The Chlorine Institute, Sodium Hypochlorite Manual, p. 71, May 2000.

Jeff Kempter, sodium/calcium hypochlorite (Chlorox Bleach, Chenical Fact Sheet, p. 4, Feb. 1986.

The Chlorox Company, Material Safety Data Sheet, Tilex Instant Mildew Remover, p. 1, Nov. 1992.

* cited by examiner

COTTON-GENTLE HYPOCHLORITE BLEACH

RELATED U.S. APPLICATION DATA

This application is a continuation of U.S. patent application Ser. No. 11/505,445, filed Aug. 17, 2006, which is a continuation of U.S. patent application Ser. No. 10/612,016, filed Jul. 3, 2003, now U.S. Pat. No. 7,109,157, which, in turn, is a continuation-in-part of U.S. patent application Ser. No. 10/373,787, filed Feb. 27, 2003, now U.S. Pat. No. 6,946,435, which claims benefit of U.S. Provisional Application No. 60/423,978, filed Nov. 6, 2002, all of which are incorporated herein by reference in their entireties.

TECHNICAL FIELD OF THE INVENTION

This invention relates to products, methods and kits useful for removing stains, such as menstrual fluid or underarm perspiration stains, from clothes and other soft fabric articles. This invention also relates to methods for reducing the damaging effect of hypochlorite-containing solution on cotton and other soft fabrics.

BACKGROUND OF THE INVENTION

Menstrual fluid, a composition of blood and endometrial cells, is difficult to remove from cotton panties once it has stained the fabric. Regular bleach is one of the leading household products used for the purpose of cleaning white cotton panties of menstrual fluid stain. Ultra Clorox® Regular Bleach is a designated trademark of the Clorox® Company. A typical, undiluted regular bleach solution contains about 6 wt % of sodium hypochlorite and less than 0.2 wt % of sodium hydroxide. The pH of the undiluted Clorox® Regular Bleach solution is around 11.4. Like other chlorine-releasing bleaches, Clorox® Regular Bleach, even diluted, will disintegrate the fabric. Moreover, even after lengthy soaking, a dark residue stain may still remain on the cotton fabric, even with scrubbing. Vigorous scrubbing accelerates deterioration of the bleach-weakened cotton fibers which, again, leads to damaged panties, and expense and frustration. Some household products, such as hydrogen peroxide, produce free oxygen to dislodge menstrual fluid discharge from cotton fabric but this process may be effective only when the discharge is fresh and minimal fluid penetration of the fabric has occurred.

Perspiration stain in the underarm areas of white cotton fabric shirts and blouses is also difficult to remove, even for professionals in the garment laundry and cleaner business. Often the stain is not completely removed.

There is a clamor among women around the world for a process that they can use to remove fresh, set-in or old menstrual fluid or perspiration stain from white cotton fabric, a process that can be used easily, rapidly, with little or no scrubbing, and with no damage to the cotton fabric.

SUMMARY OF THE INVENTION

One object of the present invention is to provide cleaning products and methods for reducing the damaging effect of hypochlorite-containing solutions on soft fabrics. The fabrics can be made of cotton, cotton/polyester, or other materials. The fabrics may be, for example, in white.

In accordance with one aspect of the present invention, the method comprises the steps of modifying a hypochlorite-containing solution by adding an alkali metal hydroxide to the solution, such that the weight concentration ratio of the hypochlorite salt over the alkali metal hydroxide in the modified solution is less than 12.5:1, where the modified solution can then be used in contacting a stain on a soft fabric article for at least one minute to remove the stain. In certain cases, the contact with the stain can last for at least 5, 10, 15, 30, 60 minutes or longer before the stain is cleaned, necessitating an appropriate weight concentration ratio in order to maintain a reduced damaging effect.

The stain can be any type of hard-to-remove stains, such as fresh, set-in or old menstrual fluid or underarm perspiration stains. Other examples of hard-to-remove stains include, but are not limited to, those caused by wine, grass, urine, feces, and certain types of ink.

In a preferred embodiment, the alkali metal hydroxide is sodium hydroxide, and the hypochlorite salt is sodium hypochlorite. The weight concentration ratio of sodium hypochlorite over sodium hydroxide in the modified solution can be less than 10:1, 5:1, and about 3:1 to 1:1. A sodium hypochlorite/sodium hydroxide ratio also can be less than 1:1.

In one embodiment, the modified solution includes at least 0.2, 0.3, 0.5, 1, 2, 3 or higher weight percent of sodium hydroxide. For instance, the weight percentage of sodium hydroxide can range from about 0.5% to about 3%.

In another embodiment, the modified solution includes about 2.5 weight percent of sodium hypochlorite and 0.5 to 1.25 weight percent of sodium hydroxide. In yet another embodiment, the modified solution includes about 6 weight percent of sodium hypochlorite and 1.2 to 3 weight percent of sodium hydroxide.

In accordance with another aspect of the present invention, the method for reducing the damaging effect of a hypochlorite salt-containing solution comprises the steps of modifying the solution by adding an alkali metal hydroxide to the solution, such that the pH of the modified solution is at least 11.8, where the modified solution can then be used in contacting a stain on a soft fabric article for at least one minute to remove the stain. The fabric article may be, for example, in white.

The pH of the modified solution can be at least 12, 12.5 or 13. In one embodiment, the pH of the modified solution is about 13.

In a preferred embodiment, the alkali metal hydroxide is sodium hydroxide, and the hypochlorite salt is sodium hypochlorite. The weight percentage of sodium hypochlorite in the modified solution can be at least 0.5%, 1%, 2%, 3%, 4%, 5%, 6% or more.

In one embodiment, the modified solution is a modified form of Ultra Clorox® Bleach Regular. Ultra Clorox® Bleach Regular typically contains about 6 weight percent of sodium hypochlorite and less than 0.2 weight percent of sodium hydroxide. To make the modified solution with reduced damaging effect, an additional amount of sodium hydroxide is added.

Another object of the present invention is to provide products, methods and kits useful for removing hard-to-remove stains from soft fabric articles. The soft fabric articles can be, for example, panties, shirts, blouses, pants, jeans, trousers or other soft fabric articles. The removal preferably is accomplished with little or no scrubbing of the fabrics.

In one embodiment, the metallic salt of hypochlorous acid is sodium hypochlorite, and the alkali metal hydroxide is sodium hydroxide. The cleaning composition can include, for example, at least 0.3 weight percent of sodium hydroxide. Preferably, the cleaning composition contains about 0.5 to about 3 weight percent of sodium hydroxide. In one embodiment, the weight concentration ratio of sodium hypochlorite over sodium hydroxide is preferably about 2:1.

The stain to be removed can be menstrual fluid or underarm perspiration stain. For the weight concentration ratio of sodium hypochlorite over sodium hydroxide of about 2:1, the contact between the cleaning composition and the stain can last at least five, fifteen, thirty minutes, or longer, with no damage to the soft fabric article.

In accordance with another aspect of the present invention, the method includes the steps of providing a cleaning composition which contains an effective amount of a metallic salt of hypochlorous acid and has a pH of at least 11.8, where the cleaning composition can then be used in contacting a stain on a soft fabric article for at least one minute. The metallic salt of hypochlorous acid preferably is sodium hypochlorite.

In accordance with yet another aspect of the present invention, a kit is provided that is useful for removing stains from clothes or other soft fabrics. The kit includes a cleaning composition which contains an effective amount of a metallic salt of hypochlorous acid and at least 0.2 weight percent of an alkali metal hydroxide. The kit also has an instruction indicating that the cleaning composition contained therein can be used for removing stains from soft fabric articles. In another embodiment, the kit includes a spray bottle capable of spraying the cleaning composition onto the soft fabric article.

In accordance with yet another aspect of the present invention, the kit includes a cleaning composition which contains an effective amount of a metallic salt of hypochlorous acid and which has a pH of at least 11.8. The kit also has an instruction for removing stains from soft fabric articles employing the cleaning composition. The metallic salt of hypochlorous acid preferably is sodium hypochlorite. In one embodiment, the cleaning composition includes 0.5-3 weight percent of sodium hydroxide.

In one embodiment, the cleaning composition contains at least 0.3 weight percent of sodium hydroxide. In another embodiment, the cleaning composition contains about 0.5 to about 3 weight percent of sodium hydroxide. The pH of the cleaning composition can be, for example, at least 12, 12.5, or 13. The cleaning composition can contact with the stain on the soft fabric article for at least five, fifteen, thirty minutes, or longer, with no damage to the fabric article.

In accordance with yet another aspect of the present invention, a kit is provided that is useful for removing stains from clothes or other soft fabrics. The kit includes a cleaning composition which contains an effective amount of a metallic salt of hypochlorous acid and at least 0.2 weight percent of an alkali metal hydroxide. The kit also has an instruction indicating that the cleaning composition contained therein can be used for removing stains from soft fabric articles.

The metallic salt of hypochlorous acid preferably is sodium hypochlorite, and the alkali metal hydroxide preferably is sodium hydroxide. In one embodiment, the cleaning composition comprises about 0.5 to about 3 weight percent of sodium hydroxide. In one embodiment, the weight concentration ratio of sodium hypochlorite over sodium hydroxide is about 2:1. In another embodiment, a kit includes a spray bottle capable of spraying the cleaning composition onto the soft fabric article.

Other features, objects, and advantages of the present invention are apparent in the detailed description that follows. It should be understood, however, that the detailed description, while indicating preferred embodiments of the present invention; is given by way of illustration only, not limitation. Various changes and modifications within the scope of the invention will become apparent to those skilled in the art from the detailed description.

DETAILED DESCRIPTION OF THE INVENTION

The present invention is based on a bleach cleaning composition which contains a metallic salt of hypochlorous acid and an alkali metal hydroxide for removing hard-to-remove stains from clothes and other soft fabric articles. In addition, appropriate amounts of alkali metal hydroxide added to a hypochlorite solution retard the damaging effect of the hypochlorite solution on soft fabric (such as cotton fabric). The metallic salt of hypochlorous acid preferably is sodium hypochlorite. The alkali metal hydroxide preferably is sodium hydroxide. Other hypochlorous salts and/or alkali metal hydroxides can also be used in the present invention.

The concentration of sodium hypochlorite in the bleach cleaning composition of the present invention preferably is at least 0.5% by weight, based on the total weight of the cleaning composition. For instance, the concentration of sodium hypochlorite can be at least 0.5, 1, 2, 3, 4, 5, 6, 7 or 8% by weight. In one embodiment, the concentration of sodium hypochlorite ranges from 0.5 to 10% by weight. In another embodiment, the concentration of sodium hypochlorite is about 0.5 to 5% by weight. In yet another embodiment, the concentration of sodium hypochlorite is about 1 to 2.5% by weight. In still another embodiment, the concentration of sodium hypochlorite is about 1.5 to 2% by weight.

The concentration of sodium hydroxide in the bleach cleaning composition preferably is at least 0.2% by weight, based on the total weight of the cleaning composition. For instance, the concentration of sodium hydroxide can be at least about 0.3, 0.4, 0.5, 1, 1.5, 2, 2.5, 3, 4 or 5% by weight. In one embodiment, the concentration of sodium hydroxide ranges from about 0.5 to about 3% by weight. In another embodiment, the concentration of sodium hydroxide ranges from about 1 to 2% by weight. Without limiting the present invention to any particular mechanism, Applicant has found that an appropriate amount of alkali metal hydroxide (such as sodium hydroxide) significantly increases the compatibility of sodium hypochlorite with soft fabric, such as cotton fabric, thereby preventing sodium hypochlorite from damaging the fabric.

The weight concentration ratio of sodium hypochlorite over sodium hydroxide may vary substantially without affecting the stain-removing power of the cleaning composition. However, the fabric damaging effect of hypochlorite varies with the weight concentration ratio for a given concentration of hypochlorite. Preferably, the weight concentration ratio of sodium hypochlorite over sodium hydroxide is less than 12.5:1. In one embodiment, the weight concentration ratio of sodium hypochlorite over sodium hydroxide can range from about 5:1 to about 1:5. In another embodiment, the weight concentration ratio of sodium hypochlorite over sodium hydroxide is about 3:1 to about 1:1. Ideally, the ratio is about 2:1 for minimum damaging effect.

In one embodiment, the bleach cleaning composition includes about 6 weight percent of sodium hypochlorite and 1.2 to 3 weight percent of sodium hydroxide. In another embodiment, the cleaning composition includes about 2.5 weight percent of sodium hypochlorite and 0.5 to 1.25 weight percent of sodium hydroxide. In both embodiments, the concentration ratio varies from 5:1 to 2:1. Hence, in both embodiments, the range of concentration ratios is the same and, likewise, the degree of fabric damage effect can be expected to follow suit, ranging to the same minimum. However, in the two embodiments, the pH values are different. It is noted that the concentration ratio is dependent on both the hypochlorite and the hydroxide, whereas the pH is dependent on only the hydroxide. The cleaning composition of the present invention can be a form of regular Clorox® Bleach modified with additional sodium hydroxide.

The pH of the cleaning composition preferably is at least about 11.8. For instance, the pH of the cleaning composition can be at least 12, 12.5 or 13. In one embodiment, the pH of the cleaning composition is about 13.

Other ingredients or additives can be added in the bleach cleaning composition. These ingredients or additives include, for example, chelating agents, phosphorous-containing salts, surfactants, or abrasive agents. These ingredients or additives, however, are not necessary for the stain-removing function of the cleaning composition. In one embodiment, the cleaning composition is free of chelating agents, phosphorous-containing salts, surfactants, and abrasive agents.

The bleach cleaning composition of the present invention can be stored in a container, such as a spray bottle, prior to use. Preferably, the container has an instruction indicating that the enclosed cleaning composition can be used for removing menstrual fluid, perspiration, and other such difficult stains from soft fabric articles and to do so with fabric protection.

Sodium hypochlorite and sodium hydroxide can be separately stored prior to use. For instance, they can be stored in two separate compartments of a container. The first compartment encloses a sodium hypochlorite solution. The second compartment encloses a concentrated sodium hydroxide solution. The two solutions are mixed together upon use. An exemplary device suitable for this purpose is illustrated in U.S. Pat. No. 6,398,077, which is incorporated herein by reference.

Soft fabric articles suitable for the present invention can be made of a variety of materials, such as cotton or cotton/polyester. The fabric articles preferably are in white or colorfast fabrics. Examples of soft fabric articles suitable for the present invention include, but are not limited to, panties, shirts, blouses, pants, jeans, trousers, and other wear and bed products.

The stains to be removed can be menstrual fluid stains or underarm perspiration stains. Other hard-to-remove stains, such as wine, grass, urine, feces, or ink stains, can also be removed using the present invention. The contact between the bleach cleaning solution and the stain may last for at least one minute before the stain is removed. In one embodiment, the contact between the cleaning solution and the stain lasts for at least 5, 10, 15, 30, 60 or more minutes before the stain is removed.

In accordance with one aspect of the present invention, the soft fabric article that is to be de-stained is first soaked in cold water until the stain areas are thoroughly saturated with water. The fabric article can be swirled around in the water to dislodge as much stain as possible. For articles heavily soiled with stains, the water may be changed to repeat the soaking and swirling step The fabric article is then squeezed to remove excess water. White cotton articles heavily stained with menstrual fluid may be tinted slightly pink after this step. The stained areas are arranged for maximal exposure in preparation for the spray with the cleaning composition.

The cleaning composition can be sprayed on the stain areas, or the entire article if necessary. After spraying, the stain areas can be compressed and confined into a small container to saturate and soak the stain areas or the entire article in the cleaner.

The stained areas are soaked with the cleaning composition until the stain has been removed. This may require about one to five minutes for removing fresh menstrual fluid stain, and about thirty minutes or more for removing old underarm perspiration stain. The fabric article can be subsequently inspected for any remaining stain. If necessary, spot spray can be applied again to remove the remaining stain.

After all stain has been removed, the fabric article is thoroughly rinsed in cold water before being put through the detergent wash/rinse and dry cycle, particularly if the fabric article is combined with non-colorfast clothing in the wash. Also, this assures that all sodium hydroxide has been removed from the fabric article before it is worn next to the skin. According to the present invention, menstrual fluid stains or underarm perspiration stains may be removed from a soft fabric article with little or no scrubbing of the article.

After the stain is removed, the fabric article preferably is not soaked with the cleaning composition any longer than necessary.

It should be understood that the above-described embodiments and the following examples are given by way of illustration, not limitation. Various changes and modifications within the scope of the present invention will become apparent to those skilled in the art from the present description.

EXAMPLES

Example I

Comparison of Clorox® Bleach to a Cleaning Composition Comprising 2.4 wt % Sodium Hypochlorite and 1.25% Sodium Hydroxide Two similar patches (approximately 2.5×2.5 $cm^2$) of 100% cotton fabric were cut from the crotch of a new panty. The first patch was immersed in a diluted Clorox® Bleach solution. The diluted Clorox® Bleach solution contained about 2.4 wt % sodium hypochlorite. After six hours of soaking, the first patch showed signs of shredding. After ten hours of soaking, the first patch shredded completely. In comparison, the second patch was immersed in a solution which contains about 2.4 wt % sodium hypochlorite and 1.25 wt % sodium hydroxide. After ten hours of soaking, no effect of shredding was observed.

Example II

The Damage Effects of Hypochlorite Solutions to Cotton Patches and the Reduction Thereof Cotton patches which were resistant to hand-tearing were soaked in different bleach solutions until damages have begun to occur as evidenced by weakening of the fabric such that it can be torn by hands with moderate forces. For each bleach solution to be tested, multiple cotton patches were used. Each patch was inserted into a vial containing the bleaching solution. The patch was removed periodically from the vial to determine the extent of damage by manually administering a tearing action. $T_c(D)$ was the cumulative time of soaking before the patch became hand-tearable.

The bleach solutions were modified from Ultra Clorox® Bleach which contains about 6% NaOCl and less than 0.2% NaOH. Additional NaOH in dry form was added to Ultra Clorox® Bleach to increase the concentration of NaOH. As Table 1 shows, Ultra Clorox® Bleach damages cotton fabrics in an accumulated time of approximately one hour. Decreasing the ratio of NaOCl/NaOH progressively increases the accumulated times for which the bleach solution is cotton-safe. This Example indicates that NaOH, added to Ultra Clorox® Bleach, can abate the damage of cotton fabrics; thereby rendering the bleach solution cotton-safe.

TABLE 1

Comparison of the Damage Effects of Bleaching Solutions

| Cleaning Solution | NaOH (weight percentage) | NaOCl/NaOH (weight percentage ratio) | $T_c$ (D) (hours) |
|---|---|---|---|
| Ultra Clorox Beach | 0-0.2 | over 30:1 | 1 |
| Solution #1 | 0.4-0.6 | 12:1 | 4 |
| Solution #2 | 1.0-1.2 | 5.5:1 | 6 |
| Solution #3 | 2.0-2.2 | 3:1 | 6 |
| Solution #4 | 3.0-3.2 | 2:1 | 9.5 |
| Solution #5 | 4.0-4.2 | 1.5:1 | 9.5 |
| Solution #6 | 6.0-6.2 | 1:1 | 9.5 |

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

What is claimed is:

1. A method for determining the quality of fabric safety of a aqueous metallic salt of hypochlorous acid bleach solution for use in cleaning a stain from a soft fabric article, said method comprising, providing said solution as an admixture of metallic salt of hypochlorous acid and alkali metal hydroxide, wherein the metallic salt of hypochlorous acid and alkali metal hydroxide ingredients of the admixture are related by a weight concentration ratio, said ratio defined as the weight percent concentration of metallic salt of hypochlorous acid over the weight percent concentration of alkali metal hydroxide, wherein the numerical value of said ratio does not exceed 30:1, and said numerical value of said ratio is an index pointing out the quality of fabric safety of said admixture, said quality of fabric safety on a scale ranging from cotton damaging to cotton safe, whereas said admixture is a composition consisting of an effective amount of metallic salt of hypochlorous acid, and a alkali metal hydroxide.

2. The method according to claim 1, wherein said soft fabric article is white or colorfast cloth made of cotton or a blend of cotton and polyester.

3. The method according to claim 1, further comprising: an instruction provided to a consumer on contacting said bleach cleaning composition on said soft fabric article.

4. The method according to claim 3, wherein said instruction instructs a consumer on duration of application of said bleach cleaning composition on said stain on said soft fabric article, and wherein said duration is selected from the group of durations: up to 1 minute, up to 5 minutes, up to 15 minutes, not less than 15 minutes.

5. The method according to claim 1, wherein said metallic salt of hypochlorous acid is sodium hypochlorite, and said alkali metal hydroxide is sodium hydroxide.

6. The method according to claim 5, wherein said bleach cleaning composition includes a given percentage of sodium hypochlorite, said given percentage selected from the group consisting of: at least 0.5 weight percent, at least 1.0 weight percent, at least 2.0 weight percent and at least 5 weight percent.

7. The method according to claim 5, wherein said bleach cleaning composition includes a given percentage of sodium hydroxide, said given percentage determined from the weight concentration ratio and the weight percent concentration of sodium hypochlorite or selected from the group consisting of: at least 0.2 weight percent, at least 0.3 weight percent, at least 0.5 weight percent, at least 1.0 weight percent, at least 2.0 weight percent, at least 2.25 weight percent, at least 2.5 weight percent, at least 3.0 weight percent, from about 0.5 to about 1.25 weight percent, from about 1.0 to about 2.0 weight percent, from about 1.2 weight percent to about 3.0 weight percent, and from about 0.5 to about 3.0 weight percent.

8. The method according to claim 5, wherein the weight concentration ratio is selected from the group consisting of no more than 30:1, no more than 20:1, no more than 10:1, no more than 5:1, no more than 2.5:1, about 2:1, and about 5:1 to 1:5, wherein decreasing the weight concentration ratio of a given composition with given sodium hypochlorite weight concentration by increasing the sodium hydroxide weight concentration of said composition progressively increases the accumulated time of soaking for which the bleach composition is cotton-safe, wherein said accumulated time is maximum when said ratio, in one embodiment, is about 2:1, whereas in another embodiment, when said ratio is about 1:1 to about 3:1.

9. The method according to claim 1, wherein said bleach cleaning composition is contained in a container having an instruction thereon regarding use of said cleaning composition.

10. The method according to claim 9, wherein said bleach cleaning composition is contained in a container, said container comprising a spray bottle, whereby said bleach cleaning composition is sprayed onto said soft fabric article.

11. The method according to claim 1, wherein the pH of the resultant solution is a pH selected from the group consisting of: at least 11, at least 12, at least 12.5 and at least 13.

12. A aqueous hypochlorite-based bleach product for cleaning a soft fabric article, said bleach product sorted by quality of fabric safety, said quality of fabric safety on a scale ranging from cotton damaging to cotton safe, wherein said quality of fabric safety is determined by the numerical value of the concentration ratio of the product admixture, said ratio defined as the concentration of metallic salt of hypochlorous acid over the concentration of alkali metal hydroxide, wherein the numerical value of said ratio does not exceed 30:1, and said numerical value of said ratio is an index of the quality of fabric safety of said product admixture, said index pointing out the quality of fabric safety on a scale ranging from cotton damaging to cotton safe, whereas said bleach product admixture is a composition consisting of an effective amount of metallic salt of hypochlorous acid, and a alkali metal hydroxide.

13. The bleach product according to claim 12, wherein said soft fabric article is white or colorfast cloth made of cotton or a blend of cotton and polyester.

14. The bleach product according to claim 12, further comprising an instruction provided to a consumer regarding removing a stain from a soft fabric article employing said cleaning composition.

15. The bleach product according to claim 14, wherein said instruction instructs a consumer on duration of application of said bleach cleaning composition on said stain on said soft fabric article, and wherein said duration is selected from the group of durations: up to 1 minute, up to 5 minutes, up to 15 minutes, not less than 15 minutes.

16. The bleach product according to claim 12, wherein said metallic salt of hypochlorous acid is sodium hypochlorite, and said alkali metal hydroxide is sodium hydroxide.

17. The bleach product according to claim 16, wherein said bleach cleaning composition includes a given percentage of sodium hypochlorite, said given percentage selected from the group consisting of: at least 0.5 weight percent, at least 1.0 weight percent, at least 2.0 weight percent and at least 5 weight percent.

18. The bleach product according to claim 16, wherein said bleach cleaning composition includes a given percentage of sodium hydroxide, said given percentage determined from the weight concentration ratio and the weight percent concentration of sodium hypochlorite or selected from the group consisting of: at least 0.2 weight percent, at least 0.3 weight percent, at least 0.5 weight percent, at least 1.0 weight percent, at least 2.0 weight percent, at least 2.25 weight percent, at least 2.5 weight percent, at least 3.0 weight percent, from about 0.5 to about 1.25 weight percent, from about 1.0 to about 2.0 weight percent, from about 1.2 weight percent to about 3.0 weight percent, and from about 0.5 to about 3.0 weight percent.

19. The bleach product according to claim 16, wherein the weight concentration ratio is selected from the group consisting of no more than 30:1, no more than 20:1, no more than 10:1, no more than 5:1, no more than 2.5:1, about 2:1, and about 5:1 to 1:5, wherein decreasing the weight concentration ratio of a given composition with given sodium hypochlorite weight concentration by increasing the sodium hydroxide weight concentration of said composition progressively increases the accumulated time of soaking for which the bleach composition is cotton-safe, wherein said accumulated time is maximum when said ratio, in one embodiment, is about 2:1, whereas in another embodiment, when said ratio is about 1:1 to about 3:1.

20. The bleach product according to claim 12, wherein said bleach cleaning composition is contained in a container having an instruction thereon regarding use of said bleach cleaning composition.

21. The bleach product according to claim 20, wherein said bleach cleaning composition is contained in a container, said container comprising a spray bottle, whereby said bleach cleaning composition is sprayed onto said soft fabric article.

22. The bleach product according to claim 12, wherein the pH of the resultant solution is a pH selected from the group consisting of: at least 11, at least 12, at least 12.5 and at least 13.

23. The method according to claim 1, wherein the weight concentration ratio of the metallic salt of hypochlorous acid over the alkali metal hydroxide ranges from 2:1 to 2.2:1, wherein 2.2:1 is excluded.

24. The method according to claim 1, wherein the weight concentration ratio of the metallic salt of hypochlorous acid over the alkali metal hydroxide ranges from 2.2:1 to 2.4:1, wherein 2.4:1 is excluded.

25. The method according to claim 1, wherein the weight concentration ratio of the metallic salt of hypochlorous acid over the alkali metal hydroxide ranges from 2.4:1 to 2.6:1, wherein 2.6:1 is excluded.

26. The method according to claim 1, wherein the weight concentration ratio of the metallic salt of hypochlorous acid over the alkali metal hydroxide ranges from 2.6:1 to 2.8:1, wherein 2.8:1 is excluded.

27. The method according to claim 1, wherein the weight concentration ratio of the metallic salt of hypochlorous acid over the alkali metal hydroxide ranges from 2.8:1 to 3:1, wherein 3:1 is excluded.

28. The method according to claim 1, wherein the weight concentration ratio of the metallic salt of hypochlorous acid over the alkali metal hydroxide ranges from 3:1 to 3.2:1, wherein 3.4:1 is excluded.

29. The method according to claim 1, wherein the weight concentration ratio of the metallic salt of hypochlorous acid over the alkali metal hydroxide ranges from 3.2:1 to 3.4:1, wherein 3.4:1 is excluded.

30. The method according to claim 1, wherein the weight concentration ratio of the metallic salt of hypochlorous acid over the alkali metal hydroxide ranges from 3.4:1 to 3.6:1, wherein 3.6:1 is excluded.

31. The method according to claim 1, wherein the weight concentration ratio of the metallic salt of hypochlorous acid over the alkali metal hydroxide ranges from 3.6:1 to 3.8:1, wherein 3.8:1 is excluded.

32. The method according to claim 1, wherein the weight concentration ratio of the metallic salt of hypochlorous acid over the alkali metal hydroxide ranges from 3.8:1 to 4:1, wherein 4:1 is excluded.

33. The method according to claim 1, wherein the weight concentration ratio of the metallic salt of hypochlorous acid over the alkali metal hydroxide ranges from 4:1 to 4.2:1, wherein 4.2:1 is excluded.

34. The method according to claim 1, wherein the weight concentration ratio of the metallic salt of hypochlorous acid over the alkali metal hydroxide ranges from 4.2:1 to 4.4:1, wherein 4.4:1 is excluded.

35. The method according to claim 1, wherein the weight concentration ratio of the metallic salt of hypochlorous acid over the alkali metal hydroxide ranges from 4.4:1 to 4.6:1, wherein 4.6:1 is excluded.

36. The method according to claim 1, wherein the weight concentration ratio of the metallic salt of hypochlorous acid over the alkali metal hydroxide ranges from 4.6:1 to 4.8:1, wherein 4.8:1 is excluded.

37. The method according to claim 1, wherein the weight concentration ratio of the metallic salt of hypochlorous acid over the alkali metal hydroxide ranges from 4.8:1 to 5:1, wherein 5:1 is excluded.

38. The method according to claim 1, wherein the weight concentration ratio of the metallic salt of hypochlorous acid over the alkali metal hydroxide ranges from 5:1 to 5.2:1, wherein 5.2:1 is excluded.

39. The method according to claim 1, wherein the weight concentration ratio of the metallic salt of hypochlorous acid over the alkali metal hydroxide ranges from 5.2:1 to 5:4:1, wherein 5.4:1 is excluded.

40. The method according to claim 1, wherein the weight concentration ratio of the metallic salt of hypochlorous acid over the alkali metal hydroxide ranges from 5.4:1 to 5:6:1, wherein 5.6:1 is excluded.

41. The method according to claim 1, wherein the weight concentration ratio of the metallic salt of hypochlorous acid over the alkali metal hydroxide ranges from 5.6:1 to 5.8:1, wherein 5.8:1 is excluded.

42. The method according to claim 1, wherein the weight concentration ratio of the metallic salt of hypochlorous acid over the alkali metal hydroxide ranges from 5.8:1 to 6:1, wherein 6:1 is excluded.

43. The method according to claim 1, wherein the weight concentration ratio of the metallic salt of hypochlorous acid over the alkali metal hydroxide ranges from 6:1 to 6.2:1, wherein 6.2:1 is excluded.

44. The method according to claim 1, wherein the weight concentration ratio of the metallic salt of hypochlorous acid over the alkali metal hydroxide ranges from 6.2:1 to 6:4:1, wherein 6.4:1 is excluded.

45. The method according to claim 1, wherein the weight concentration ratio of the metallic salt of hypochlorous acid over the alkali metal hydroxide ranges from 6.4:1 to 6.6:1, wherein 6.6:1 is excluded.

46. The method according to claim 1, wherein the weight concentration ratio of the metallic salt of hypochlorous acid over the alkali metal hydroxide ranges from 6.6:1 to 6.8:1, wherein 6.8:1 is excluded.

47. The method according to claim 1, wherein the weight concentration ratio of the metallic salt of hypochlorous acid over the alkali metal hydroxide ranges from 6.8:1 to 7.1, wherein 7:1 is excluded.

48. The method according to claim 1, wherein the weight concentration ratio of the metallic salt of hypochlorous acid over the alkali metal hydroxide ranges from 7:1 to 7.2:1, wherein 7.2:1 is excluded.

49. The method according to claim 1, wherein the weight concentration ratio of the metallic salt of hypochlorous acid over the alkali metal hydroxide ranges from 7.2:1 to 7.4:1, wherein 7.4:1 is excluded.

50. The method according to claim 1, wherein the weight concentration ratio of the metallic salt of hypochlorous acid over the alkali metal hydroxide ranges from 7.4:1 to 7.6:1, wherein 7.6:1 is excluded.

51. The method according to claim 1, wherein the weight concentration ratio of the metallic salt of hypochlorous acid over the alkali metal hydroxide ranges from 7.6:1 to 7.8:1, wherein 7.8:1 is excluded.

52. The method according to claim 1, wherein the weight concentration ratio of the metallic salt of hypochlorous acid over the alkali metal hydroxide ranges from 7.8:1 to 8.1, wherein 8:1 is excluded.

53. The method according to claim 1, wherein the weight concentration ratio of the metallic salt of hypochlorous acid over the alkali metal hydroxide ranges from 8:1 to 8.2:1, wherein 8.2:1 is excluded.

54. The method according to claim 1, wherein the weight concentration ratio of the metallic salt of hypochlorous acid over the alkali metal hydroxide ranges from 8.2:1 to 8.4:1, wherein 8.4:1 is excluded.

55. The method according to claim 1, wherein the weight concentration ratio of the metallic salt of hypochlorous acid over the alkali metal hydroxide ranges from 8.4:1 to 8.6:1, wherein 8.6:1 is excluded.

56. The method according to claim 1, wherein the weight concentration ratio of the metallic salt of hypochlorous acid over the alkali metal hydroxide ranges from 8.6:1 to 8.8:1, wherein 8.8:1 is excluded.

57. The method according to claim 1, wherein the weight concentration ratio of the metallic salt of hypochlorous acid over the alkali metal hydroxide ranges from 8.8:1 to 9:1, wherein 9:1 is excluded.

58. The method according to claim 1, wherein the weight concentration ratio of the metallic salt of hypochlorous acid over the alkali metal hydroxide ranges from 9:1 to 9.2:1, wherein 9.2:1 is excluded.

59. The method according to claim 1, wherein the weight concentration ratio of the metallic salt of hypochlorous acid over the alkali metal hydroxide ranges from 9.2:1 to 9.4:1, wherein 9.4:1 is excluded.

60. The method according to claim 1, wherein the weight concentration ratio of the metallic salt of hypochlorous acid over the alkali metal hydroxide ranges from 9.4:1 to 9.6:1, wherein 9.6:1 is excluded.

61. The method according to claim 1, wherein the weight concentration ratio of the metallic salt of hypochlorous acid over the alkali metal hydroxide ranges from 9.6:1 to 9.8:1, wherein 9.8:1 is excluded.

62. The method according to claim 1, wherein the weight concentration ratio of the metallic salt of hypochlorous acid over the alkali metal hydroxide ranges from 9.8:1 to 10:1, wherein 10:1 is excluded.

63. The method according to claim 1, wherein the weight concentration ratio of the metallic salt of hypochlorous acid over the alkali metal hydroxide ranges from 10:1 to 10.2:1, wherein 10.2:1 is excluded.

64. The method according to claim 1, wherein the weight concentration ratio of the metallic salt of hypochlorous acid over the alkali metal hydroxide ranges from 10.2:1 to 10.4:1, wherein 10.4:1 is excluded.

65. The method according to claim 1, wherein the weight concentration ratio of the metallic salt of hypochlorous acid over the alkali metal hydroxide ranges from 10.4:1 to 10.6:1, wherein 10.6:1 is excluded.

66. The method according to claim 1, wherein the weight concentration ratio of the metallic salt of hypochlorous acid over the alkali metal hydroxide ranges from 10.6:1 to 10.8:1, wherein 10.8:1 is excluded.

67. The method according to claim 1, wherein the weight concentration ratio of the metallic salt of hypochlorous acid over the alkali metal hydroxide ranges from 10.8:1 to 11:1, wherein 11:1 is excluded.

68. The method according to claim 1, wherein the weight concentration ratio of the metallic salt of hypochlorous acid over the alkali metal hydroxide ranges from 11:1 to 11.2:1, wherein 11.2:1 is excluded.

69. The method according to claim 1, wherein the weight concentration ratio of the metallic salt of hypochlorous acid over the alkali metal hydroxide ranges from 11.2:1 to 11.4:1, wherein 11.4:1 is excluded.

70. The method according to claim 1, wherein the weight concentration ratio of the metallic salt of hypochlorous acid over the alkali metal hydroxide ranges from 11.4:1 to 11.6:1, wherein 11.6:1 is excluded.

71. The method according to claim 1, wherein the weight concentration ratio of the metallic salt of hypochlorous acid over the alkali metal hydroxide ranges from 11.6:1 to 11.8:1, wherein 11.8:1 is excluded.

72. The method according to claim 1, wherein the weight concentration ratio of the metallic salt of hypochlorous acid over the alkali metal hydroxide ranges from 11.8:1 to 12.5:1.

73. The method according to claim 1, wherein the weight concentration ratio of the metallic salt of hypochlorous acid over the alkali metal hydroxide ranges from 10:1 to 14.9:1.

74. The method according to claim 1, wherein the weight concentration ratio of the metallic salt of hypochlorous acid over the alkali metal hydroxide ranges from 11.6:1 to 17.5:1.

75. The method according to claim 1, wherein the weight concentration ratio of the metallic salt of hypochlorous acid over the alkali metal hydroxide ranges from 12.5:1 to 16.6:1.

76. The method according to claim 1, wherein the weight concentration ratio of the metallic salt of hypochlorous acid over the alkali metal hydroxide ranges from 13.3:1 to 20:1.

77. The bleach product according to claim 12, wherein the weight concentration ratio of the metallic salt of hypochlorous acid over the alkali metal hydroxide ranges from 2:1 to 2.2:1, wherein 2.2:1 is excluded.

78. The bleach product according to claim 12, wherein the weight concentration ratio of the metallic salt of hypochlorous acid over the alkali metal hydroxide ranges from 2.2:1 to 2.4:1, wherein 2.4:1 is excluded.

79. The bleach product according to claim 12, wherein the weight concentration ratio of the metallic salt of hypochlorous acid over the alkali metal hydroxide ranges from 2.4:1 to 2.6:1, wherein 2.6:1 is excluded.

80. The bleach product according to claim 12, wherein the weight concentration ratio of the metallic salt of hypochlorous acid over the alkali metal hydroxide ranges from 2.6:1 to 2.8:1, wherein 2.8:1 is excluded.

81. The bleach product according to claim 12, wherein the weight concentration ratio of the metallic salt of hypochlorous acid over the alkali metal hydroxide ranges from 2.8:1 to 3:1, wherein 3.1:1 is excluded.

82. The bleach product according to claim 12, wherein the weight concentration ratio of the metallic salt of hypochlorous acid over the alkali metal hydroxide ranges from 3:1 to 3.2:1, wherein 3.2:1 is excluded.

83. The bleach product according to claim 12, wherein the weight concentration ratio of the metallic salt of hypochlorous acid over the alkali metal hydroxide ranges from 3.2:1 to 3.4:1, wherein 3.4:1 is excluded.

84. The bleach product according to claim 12, wherein the weight concentration ratio of the metallic salt of hypochlorous acid over the alkali metal hydroxide ranges from 3.4:1 to 3.6:1, wherein 3.6:1 is excluded.

85. The bleach product according to claim 12, wherein the weight concentration ratio of the metallic salt of hypochlorous acid over the alkali metal hydroxide ranges from 3.6:1 to 3.8:1, wherein 3.8:1 is excluded.

86. The bleach product according to claim 12, wherein the weight concentration ratio of the metallic salt of hypochlorous acid over the alkali metal hydroxide ranges from 3.8:1 to 4:1, wherein 4:1 is excluded.

87. The bleach product according to claim 12, wherein the weight concentration ratio of the metallic salt of hypochlorous acid over the alkali metal hydroxide ranges from 4:1 to 4.2:1, wherein 4.2:1 is excluded.

88. The bleach product according to claim 12, wherein the weight concentration ratio of the metallic salt of hypochlorous acid over the alkali metal hydroxide ranges from 4.2:1 to 4.4:1, wherein 4.4:1 is excluded.

89. The bleach product according to claim 12, wherein the weight concentration ratio of the metallic salt of hypochlorous acid over the alkali metal hydroxide ranges from 4.4:1 to 4.6:1, wherein 4.6:1 is excluded.

90. The bleach product according to claim 12, wherein the weight concentration ratio of the metallic salt of hypochlorous acid over the alkali metal hydroxide ranges from 4.6:1 to 4.8:1, wherein 4.8:1 is excluded.

91. The bleach product according to claim 12, wherein the weight concentration ratio of the metallic salt of hypochlorous acid over the alkali metal hydroxide ranges from 4.8:1 to 5:1, wherein 5:1 is excluded.

92. The bleach product according to claim 12, wherein the weight concentration ratio of the metallic salt of hypochlorous acid over the alkali metal hydroxide ranges from 5:1 to 5.2:1, wherein 5.2:1 is excluded.

93. The bleach product according to claim 12, wherein the weight concentration ratio of the metallic salt of hypochlorous acid over the alkali metal hydroxide ranges from 5.2:1 to 5.4:1, wherein 5.4:1 is excluded.

94. The bleach product according to claim 12, wherein the weight concentration ratio of the metallic salt of hypochlorous acid over the alkali metal hydroxide ranges from 5.4:1 to 5.6:1, wherein 5.6:1 is excluded.

95. The bleach product according to claim 12, wherein the weight concentration ratio of the metallic salt of hypochlorous acid over the alkali metal hydroxide ranges from 5.6:1 to 5.8:1, wherein 5.8:1 is excluded.

96. The bleach product according to claim 12, wherein the weight concentration ratio of the metallic salt of hypochlorous acid over the alkali metal hydroxide ranges from 5.8:1 to 6:1, wherein 6:1 is excluded.

97. The bleach product according to claim 12, wherein the weight concentration ratio of the metallic salt of hypochlorous acid over the alkali metal hydroxide ranges from 6:1 to 6.2:1, wherein 6.2:1 is excluded.

98. The bleach product according to claim 12, wherein the weight concentration ratio of the metallic salt of hypochlorous acid over the alkali metal hydroxide ranges from 6.2:1 to 6.4:1, wherein 6.4:1 is excluded.

99. The bleach product according to claim 12, wherein the weight concentration ratio of the metallic salt of hypochlorous acid over the alkali metal hydroxide ranges from 6.4:1 to 6.6:1, wherein 6.6:1 is excluded.

100. The bleach product according to claim 12, wherein the weight concentration ratio of the metallic salt of hypochlorous acid over the alkali metal hydroxide ranges from 6.6:1 to 6.8:1, wherein 6.8:1 is excluded.

101. The bleach product according to claim 12, wherein the weight concentration ratio of the metallic salt of hypochlorous acid over the alkali metal hydroxide ranges from 6.8:1 to 7:1, wherein 7:1 is excluded.

102. The bleach product according to claim 12, wherein the weight concentration ratio of the metallic salt of hypochlorous acid over the alkali metal hydroxide ranges from 7:1 to 7.2:1, wherein 7.2:1 is excluded.

103. The bleach product according to claim 12, wherein the weight concentration ratio of the metallic salt of hypochlorous acid over the alkali metal hydroxide ranges from 7.2:1 to 7.4:1, wherein 7.4:1 is excluded.

104. The bleach product according to claim 12, wherein the weight concentration ratio of the metallic salt of hypochlorous acid over the alkali metal hydroxide ranges from 7.4:1 to 7.6:1, wherein 7.6:1 is excluded.

105. The bleach product according to claim 12, wherein the weight concentration ratio of the metallic salt of hypochlorous acid over the alkali metal hydroxide ranges from 7.6:1 to 7.8:1, wherein 7.8:1 is excluded.

106. The bleach product according to claim 12, wherein the weight concentration ratio of the metallic salt of hypochlorous acid over the alkali metal hydroxide ranges from 7.8:1 to 8:1, wherein 8:1 is excluded.

107. The bleach product according to claim 12, wherein the weight concentration ratio of the metallic salt of hypochlorous acid over the alkali metal hydroxide ranges from 8:1 to 8.2:1, wherein 8.2:1 is excluded.

108. The bleach product according to claim 12, wherein the weight concentration ratio of the metallic salt of hypochlorous acid over the alkali metal hydroxide ranges from 8.2:1 to 8:4:1, wherein 8.4:1 is excluded.

109. The bleach product according to claim 12, wherein the weight concentration ratio of the metallic salt of hypochlorous acid over the alkali metal hydroxide ranges from 8.4:1 to 8.6:1, wherein 8.6:1 is excluded.

110. The bleach product according to claim 12, wherein the weight concentration ratio of the metallic salt of hypochlorous acid over the alkali metal hydroxide ranges from 8.6:1 to 8.8:1, wherein 8.8:1 is excluded.

111. The bleach product according to claim 12, wherein the weight concentration ratio of the metallic salt of hypochlorous acid over the alkali metal hydroxide ranges from 8.8:1 to 9:1, wherein 9:1 is excluded.

112. The bleach product according to claim 12, wherein the weight concentration ratio of the metallic salt of hypochlorous acid over the alkali metal hydroxide ranges from 9:1 to 9.2:1, wherein 9.2:1 is excluded.

113. The bleach product according to claim 12, wherein the weight concentration ratio of the metallic salt of hypochlorous acid over the alkali metal hydroxide ranges from 9.2:1 to 9.4:1, wherein 9.4:1 is excluded.

114. The bleach product according to claim 12, wherein the weight concentration ratio of the metallic salt of hypochlorous acid over the alkali metal hydroxide ranges from 9.4:1 to 9.6:1, wherein 9.6:1 is excluded.

115. The bleach product according to claim 12, wherein the weight concentration ratio of the metallic salt of hypochlorous acid over the alkali metal hydroxide ranges from 9.6:1 to 9.8:1, wherein 9.8:1 is excluded.

116. The bleach product according to claim 12, wherein the weight concentration ratio of the metallic salt of hypochlorous acid over the alkali metal hydroxide ranges from 9.8:1 to 10:1, wherein 10:1 is excluded.

117. The bleach product according to claim 12, wherein the weight concentration ratio of the metallic salt of hypochlorous acid over the alkali metal hydroxide ranges from 10:1 to 10.2:1, wherein 10.2:1 is excluded.

118. The bleach product according to claim 12, wherein the weight concentration ratio of the metallic salt of hypochlorous acid over the alkali metal hydroxide ranges from 10.2:1 to 10.4:1, wherein 10.4:1 is excluded.

119. The bleach product according to claim 12, wherein the weight concentration ratio of the metallic salt of hypochlorous acid over the alkali metal hydroxide ranges from 10.4:1 to 10.6:1, wherein 10.6:1 is excluded.

120. The bleach product according to claim 12, wherein the weight concentration ratio of the metallic salt of hypochlorous acid over the alkali metal hydroxide ranges from 10.6:1 to 10.8:1, wherein 10.8:1 is excluded.

121. The bleach product according to claim 12, wherein the weight concentration ratio of the metallic salt of hypochlorous acid over the alkali metal hydroxide ranges from 10.8:1 to 11:1, wherein 11:1 is excluded.

122. The bleach product according to claim 12, wherein the weight concentration ratio of the metallic salt of hypochlorous acid over the alkali metal hydroxide ranges from 11:1 to 11.2:1, wherein 11.2:1 is excluded.

123. The bleach product according to claim 12, wherein the weight concentration ratio of the metallic salt of hypochlorous acid over the alkali metal hydroxide ranges from 11.2:1 to 11.4:1, wherein 11.4:1 is excluded.

124. The bleach product according to claim 12, wherein the weight concentration ratio of the metallic salt of hypochlorous acid over the alkali metal hydroxide ranges from 11.4:1 to 11.6:1, wherein 11.6:1 is excluded.

125. The bleach product according to claim 12, wherein the weight concentration ratio of the metallic salt of hypochlorous acid over the alkali metal hydroxide ranges from 11.6:1 to 11.8:1, wherein 11.8:1 is excluded.

126. The bleach product according to claim 12, wherein the weight concentration ratio of the metallic salt of hypochlorous acid over the alkali metal hydroxide ranges from 11.8:1 to 12:5:1.

127. The bleach product according to claim 12, wherein the weight concentration ratio of the metallic salt of hypochlorous acid over the alkali metal hydroxide ranges from 10:1 to 14.9:1.

128. The bleach product according to claim 12, wherein the weight concentration ratio of the metallic salt of hypochlorous acid over the alkali metal hydroxide ranges from 11.6:1 to 17.5:1.

129. The bleach product according to claim 12, wherein the weight concentration ratio of the metallic salt of hypochlorous acid over the alkali metal hydroxide ranges from 12.5:1 to. 16.6:1.

130. The bleach product according to claim 12, wherein the weight concentration ratio of the metallic salt of hypochlorous acid over the alkali metal hydroxide ranges from 13.3:1 to 20:1.

* * * * *